US005089362A

United States Patent [19]

Chou et al.

[11] Patent Number: 5,089,362

[45] Date of Patent: Feb. 18, 1992

[54] METALLIC TONER FLUID COMPOSITION

[75] Inventors: Hsin H. Chou; Wu-Shyong Li; Robin E. Wright, all of St. Paul, Minn.

[73] Assignee: Minnesota Mining and Manufacturing Company, St. Paul, Minn.

[21] Appl. No.: 648,913

[22] Filed: Feb. 1, 1991

[51] Int. Cl.[5] ..... G03G 13/10

[52] U.S. Cl. ..... 430/16; 430/38

[58] Field of Search ..... 430/38, 16

[56] References Cited

U.S. PATENT DOCUMENTS

| | | | |
|---|---|---|---|
| 4,272,596 | 6/1981 | Harbour et al. | 430/37 |
| 4,665,002 | 5/1987 | Dan et al. | 430/114 |
| 4,892,798 | 1/1990 | Lamanna et al. | 430/38 |
| 4,925,766 | 5/1990 | Elmasry et al. | 430/115 |
| 4,985,321 | 1/1991 | Chou et al. | 430/38 |
| 4,988,602 | 1/1991 | Jongewaard et al. | 430/45 |

*Primary Examiner*—Marion E. McCamish
*Assistant Examiner*—S. Rosasco
*Attorney, Agent, or Firm*—Gary L. Griswold; Lorraine R. Sherman; Karl G. Hanson

[57] ABSTRACT

A metallic toner fluid composition that contains (A) electrostatically charged, colloidal elemental metal particles dispersed in an electrically nonconductive organic carrier liquid having a dielectric constant less than about 3.5 and a volume resistivity greater than about $10^{12}$ ohm-cm, (B) a soluble surfactant in an amount sufficient to charge and stabilize the colloidal metal dispersion, and (C) an effective amount of organosol particles and/or a soluble polymer that is not a soluble surfactant (B). Also disclosed is a substrate coated with elemental metallic toner fluid particles. The coated substrate can act as a donor substrate for thermal mass transfer of images to a secondary receiving substrate by performing either or both of the following steps, in any order:

(a) transferring the elemental metal coating from the primary substrate to the secondary receiving substrate;

(b) contacting the elemental metal coated primary or secondary substrate with an electroless metal plating solution.

17 Claims, No Drawings

METALLIC TONER FLUID COMPOSITION

TECHNICAL FIELD

This invention relates to (i) a metallic toner fluid composition, (ii) a method of electrophoretically depositing metallic toner fluid composition particles on a substrate, (iii) a method of metal plating, (iv) a method(s) of transferring electrophoretically deposited toner fluid composition particles or metal platings from a primary receiving substrate to a secondary receiving substrate, and (v) an article bearing a metallic coating.

BACKGROUND OF THE INVENTION

Liquid developers or toners are widely known in the art and are commonly used in electrophoretic development. Electrophoretic development is a process where dispersed-charged-pigment-particles, of a toner fluid, migrate to and deposit upon an oppositely charged surface that is in contact with the toner fluid. Conventional toner fluids typically contain charge control agents and/or surfactants and finely ground pigment particles dispersed in an insulating, organic carrier liquid. The charge control agents and/or surfactants impart electrostatic charge to the pigment particles, and stabilize pigment particles to avoid flocculation.

Although conventional toner fluid compositions have been known and used for years, only recently have metallic toner fluid compositions been known in the art. A metallic toner fluid composition is disclosed in U.S. Pat. No. 4,892,798. This toner fluid composition comprises electrostatically-charged, colloidal, elemental-metal-particles dispersed in a nonconductive organic carrier liquid having a dielectric constant less than 3.5. A surfactant is present in this dispersion in an amount sufficient to charge and stabilize the colloidal metal dispersion. This patent also discloses a method of electrophoretically depositing the metallic toner fluid particles and a method of electroless metal plating. This patent does not, however, disclose a toner fluid composition that contains small amounts of an organosol and/or polymer other than a surfactant, and it does not disclose a method of transferring deposited metallic toner fluid materials or metal platings from a primary receiving substrate to a secondary receiving substrate.

U.S. Pat. No. 4,985,321 discloses metallic toner fluid compositions and methods of transferring deposited metallic toner fluid particles and metal platings from a primary receiving substrate to a secondary receiving substrate. U.S. Pat. No. 4,985,321 does not, however, disclose that the metallic toner fluid compositions may contain small amounts of an organosol and/or a polymer other than a surfactant.

GLOSSARY

As used herein:

"anchoring group" means a polymerizable unsaturated functional group;

"dispersion" means a two phase system where one phase comprises small solid particles in the colloidal size range distributed throughout and suspended in a continuous, bulk, liquid phase;

"electrically conductive", when referring to metallic coatings, means that the conductivity of the coatings is greater than $10^3$ (ohm-cm)$^{-1}$;

"electrically nonconductive", when referring to metallic coatings, means that the conductivity of the coatings is less than or equal to $10^3$ (ohm-cm)$^{-1}$;

"electrophoretic" means relating to the migration of suspended particles in an electric field;

"image" or "patterned image" means a reproduction or representative reproduction of some original pattern of lines and/or shapes;

"metal plating" means a metallic coating obtainable by electrolessly plating a metal on a substrate possessing electrophoretically deposited metal particles;

"metallic coating" means a continuous, discontinuous, imagewise, or other pattern or layer of a metal on a substrate;

"organosol" means a dispersion of organosol particles;

"organosol particles" means polymer particles having soluble and insoluble components, which polymer particles are dispersible in organic media;

"primary receiving substrate" means a substrate surface to which a metallic coating is applied; and "secondary receiving substrate" means a substrate onto which a metallic coating is transferred from a primary receiving substrate;

"soluble surfactant" means at least 1 milligram of surfactant dissolves in 100 mL of the chosen organic carrier liquid;

"stable" means that no more than 10 percent of the particles in the colloidal dispersions settle over a period of 1 week under ambient conditions of 25° C. and 1 atmosphere pressure (760 Torr);

"surfactant" means a surface active agent or dispersing agent or charge control agent which interacts with the surface of the metal particles to provide electrostatic charge to the particles making the toner fluid stable;

"thermal mass transfer" means transfer of metal by any means involving energy, including electronic or conventional heat and pressure, where the heat may be generated in a variety of ways including resistive heating, infrared radiation absorption including laser and microwave energy, and piezoelectric energy;

"toner fluid" or "liquid developer" or "liquid toner" means a dispersion of small, charged particles in a fluid medium, which respond to an electrostatic field in such a way as to make them useful in electrophoretic coating and imaging;

SUMMARY OF THE INVENTION

This invention provides a metallic toner fluid composition, which comprises: A) electrostatically charged, colloidal elemental metal particles dispersed in an organic carrier liquid having a dielectric constant less than about 3.5 and a volume resistivity greater than about $10^{12}$ ohm-cm; B) a soluble surfactant in sufficient concentration to charge and stabilize the colloidal metal dispersion; and C) an effective amount of organosol particles and/or at least one soluble polymer that is not a soluble surfactant.

In another aspect, this invention provides a method of forming a metallic coating. This method comprises: electrophoretically depositing elemental metal particles having sizes in the range of 1 to 250 nanometers (nm) on at least a portion of at least one surface of a substrate. Simultaneously with this deposit, organosol particles and/or at least one polymer that is not a surfactant are deposited on the same substrate. The electrophoretic deposit produces a nonconductive metallic coating on the substrate surface. The coatings may be in the form of continuous or discontinuous films that may or may not possess a patterned image.

In a further aspect, this invention provides a method of metal plating, where elemental metal particles deposited on a substrate are contacted with an electroless metal plating solution for a time sufficient to provide a second metal coating which is electrically conductive.

In yet another aspect, this invention provides processes for the transfer of metallic coatings from a primary receiving substrate to a secondary receiving substrate.

In a still further aspect, this invention provides an article bearing a metallic coating. The article comprises a substrate having (i) elemental metal particles having sizes in the range of 1 to 250 nm, and (ii) organosol particles or a non-surfactant polymer or a combination thereof deposited on the substrate.

The present invention is an improvement over the metallic toner fluid compositions disclosed in U.S. Pat. Nos. 4,892,798 and 4,985,321. Unlike the toner fluid compositions of U.S. Pat. Nos. 4,892,798 and 4,985,321, this improved metallic toner fluid composition contains organosol particles and/or a soluble polymer other than a surfactant. It has been discovered that organosol particles and/or soluble polymer additives increase the effectiveness of the toner fluid composition by: (1) promoting the adhesion of the metal particles to a receptor during transfer of the particles from a donor substrate; and (2) reducing cohesion within an electroless plated metallic coating when transferring an image from that metallic coating to a receptor. The former advantage (1) is beneficial because it facilitates transferring an image from a metallic coating to a substrate having no substantial adhesive properties at the transfer temperature. The latter advantage (2) is beneficial because it promotes a clean break of an imaged area from a non-imaged area of a metal plating. The presence of organosol particles and/or soluble polymer in a metallic toner fluid composition is also beneficial in that it permits transferring an electrophoretically deposited metallic coating to a non-thermoplastic substrate. This can now be accomplished without providing additional steps such as applying a thermoplastic overcoat to the electrophoretically deposited metal particles.

DETAILED DESCRIPTION OF PREFERRED EMBODIMENTS OF THE INVENTION

In describing preferred embodiments of this invention, specific terminology will be used for the sake of clarity. The invention, however, is not intended to be limited to the specific terms so selected, and it is to be understood that each term so selected includes all the technical equivalents that operate in a similar manner to accomplish a similar purpose.

U.S. Pat. Nos. 4,892,798 and 4,985,321 disclose metallic toner fluids that contain: colloidal metal particles dispersed in a nonconductive organic carrier liquid and an effective amount of a soluble surfactant. The disclosures of these patents are incorporated here by reference.

I. METALLIC TONER FLUID COMPOSITION

The present invention provides toner fluid compositions useful for electrophoretically producing metallic coatings. The toner fluid compositions are especially useful when a metallic coating is deposited on a primary receiving substrate and is subsequently transferred to a secondary receiving substrate.

Preferred toner fluids of this invention contain: (A) electrostatically charged, essentially pure, elemental, nonferromagnetic, colloidal metal particles dispersed in a nonconductive, organic carrier liquid having a dielectric constant less than 2.5 and a volume resistivity of greater than $10^{13}$ ohm-cm; (B) a soluble surfactant in a concentration at from 0.001 to 5.0 weight percent based on the weight of the total fluid; and (C) 0.005 to 5.0 wt. % of organosol particles and/or at least one soluble polymer that is not a soluble surfactant (B) based on the weight of the toner fluid. Volume resistivity of the whole toner fluid dispersion is preferably greater than $10^9$ and more preferably greater than $10^{10}$ ohm-cm.

A. Colloidal Metal Dispersion

For preparing colloidal metal dispersions of this invention, known apparatus may be employed for generating metal vapors and contacting those vapors with a dilute solution of surfactant in an organic carrier liquid. The gas evaporation reactor (GER) as described in U.S. Pat. No. 4,871,790 has proven to be particularly suitable for this purpose. Other reactor designs, such as the Klabunde-style static reactor or a rotary reactor of the Torrovap TM design (Torrovap Industries, Markham, Ontario, Canada) may also be useful in certain instances, but are relatively limited in utility. A complete description of the three basic reactor designs and their use in preparing colloidal metal dispersions is given in U.S. Pat. No. 4,871,790. The metal vapors generated from such reactors may be in the form of atomic metal vapors or a gaseous stream of colloidal metal particles.

1. Colloidal Metal Particles

A variety of metals can be used in the stable colloidal dispersions of this invention. Metals suitable for forming stable colloidal dispersions include metals selected from the elements of atomic numbers 11–106 such as periodic table main group metals, transition metals, noble metals, rare earth metals, and metalloids, for example, aluminum and antimony. Preferred metals (in order of their atomic numbers) are: aluminum, scandium, titanium, vanadium, chromium, manganese, iron, cobalt, nickel, copper, zinc, gallium, germanium, yttrium, zirconium, niobium, molybdenum, technetium, ruthenium, rhodium, palladium, silver, cadmium, indium, tin, antimony, lanthanum, gadolinium, hafnium, tantalum, tungsten, rhenium, osmium, iridium, platinum, gold, thallium and lead. More preferred metals are non-ferromagnetic; for example: copper, gold, iridium, palladium, platinum, rhodium, silver, rhenium, ruthenium, osmium, indium, tin and lead, with palladium being more preferred than the others. The most preferred metals are the noble metals.

Colloidal elemental metal particles of this invention may be comprised of a single metal or a combination of two or more metals. Mixed metal compositions may be produced in a number of ways, which include simultaneous or sequential metal evaporation from multiple evaporation sources or evaporation of metal alloys from a single source.

Colloidal metal particle sizes may range from about 1 to 250 nm. Particle sizes ranging from 1 to 100 nm (but more commonly particles of from 2 to 50 nm) have been identified by electron microscopy. Particle sizes of 2 to 50 nm are preferred for this invention. A mean particle size of 10 nm with a standard deviation of 1 to 6 nm is more preferred. Standard deviations may be determined by a combination of electron microscopy and photon correlation spectroscopy.

The colloidal elemental metal-particles of this invention's toner fluids preferably have a metal core which is more than 99 wt. % pure metal. More preferably, the metal core is more than 99.5 wt. % pure metal. The metal core is usually crystalline, but may be amorphous depending upon the conditions used in its preparation.

The elemental metal core may be surrounded by a thin surface coating of metal oxide or metal salt formed by surface oxidation of the elemental metal in air or by a component of the liquid medium. When present, the metal oxide or salt coating can account for less than 20 mole percent, preferably less than 10 mole percent, more preferably less than 5 mole percent, of the total metal content (metal plus metal oxide or salt). In many cases, the particles are essentially free of any oxide or metal salt coating. The extent of the oxide (or salt) layer, when present, will depend on the ease of oxidation of the particular elemental metal and the sample history (i.e., degree of air exposure).

A chemically or physically adsorbed surfactant can form an extreme outer layer on the particles. Such a layer is generally associated with (that is, chemically or physically adsorbed onto) the metal particles of this invention. The surfactant layer serves to charge the particles in the dispersion and may also sterically stabilize the dispersion to impede flocculation.

The surfactant and oxide or salt layers may be continuous or non-continuous.

There are limits on the amount of metal-loadings in the fluid dispersions. Metal-loadings depend on surfactant concentration in the organic carrier liquid. Limitations exist because, at high metal concentrations, the dispersions may exhibit instability in the form of particle aggregation or flocculation. In this invention, flocculation has been avoided using low surfactant concentrations (0.01 to 1.0 g/100 ml of carrier liquid) and metal loadings of up to 1.0% by weight in the organic carrier liquid (preferably in the range of 0.0001 to 0.1% by weight). At the noted surfactant concentration, a dispersion remained stable to flocculation for a period of three months at a temperature of 25° C. and a pressure of one atmosphere. It is preferred that the metal particles' number average particle size in a dispersion increase by at most a factor of 5 (more preferably 2) over a three month period at 25° C. and one atmosphere.

2. Carrier Liquid

Carrier liquids suitable for use in this invention include nonconductive organic liquids capable of dispersing the colloidal metal particles of this invention. The more preferred carrier liquids have volume resistivities of greater than $10^{-}$ohm-cm. It is also preferred that the carrier liquid has a melting point of not exceeding 15° C., a boiling point at from 60° to 300 ° C. at 1 atmosphere pressure, and a viscosity of less than 5 centipoise at 25° C.

Classes of liquid media that may be suitable as carrier liquids include (but are not limited to): straight-chain, branched-chain, and cyclo-aliphatic hydrocarbons such as petroleum oils, naphtha, ligroin, hexane, pentane, heptane, octane, isododecane, isononane and cyclohexane; aromatic hydrocarbons such as benzene, toluene and xylene; and halocarbon liquids such as 1,1,2-trichloro-1,2,2,-trifluoroethane, trichloromonofluoromethane and carbon tetrachloride. Organic carrier liquids particularly useful for preparing toner fluid dispersions of this invention are the isoparaffinic hydrocarbons Isopar TM G (b.p.=156=176° C.) and Isopar TM M (b.p.=207-254° C) (Exxon Company USA, Houston, Tex.). The Isopar TM G and M carrier liquids have been found to be particularly suitable because they tend to possess high purity, high volume resistivity, low dielectric constant, low viscosity, and convenient boiling range.

B. Surfactants

Surfactants useful in this invention are those that are soluble in the carrier liquid and are capable of stabilizing the metal dispersion. Examples of preferred surfactants useful for this invention include epoxide terminated polyisobutylenes: Actipol TM E6, E16, and E23 (Amoco Chemical Co., Chicago, Ill.); commercial oil additives: Lubrizol TM 6401 and Lubrizol TM 6418 (The Lubrizol Corporation, Wickliffe, Ohio) Amoco TM 9250 (Amoco Petroleum Additives Company, Naperville, Ill.), and OLOA TM 1200 (Chevron Chemical Company, San Francisco, Calif.); and hydrocarbon compatible hyperdispersant such as Solsperse TM 17,000 (ICI Americas Inc., Wilmington, Del.) OLOA TM 1200, a low molecular weight polyisobutylene attached to a diamine head group by a succinimide linkage, is the more preferred surfactant because of the stability and performance it imparts to the resulting toner fluids. Usually, the surfactant will have a molecular weight of less than about 20,000, more typically less than about 10,000.

Although the above surfactants are preferred for use in this invention, it is within the scope of this invention to select other surfactant compositions, including compositions known to be effective as charge control agents in prior art toner fluid dispersions. Such surfactant compositions include natural and synthetic materials and combinations thereof, which can be neutral or ionic. Natural materials include triglycerides such as linseed oil and soybean oil, and fatty acids such as linoleic acid, linolenic acid, oleic acid, and their combinations. Synthetic surfactants generally provide superior toner fluid stability and performance. Synthetic surfactants include functionalized homopolymers and copolymers of vinyl-containing monomers. Examples of vinyl containing monomers include: N-vinylpyrrolidone, vinylalcohol, styrene, vinyltoluene, vinylpyridine, acrylates, and methylmethacrylate; and block, graft or random copolymers such as those having the following monomer combinations: styrene-butadiene, vinylchloride-vinyl ether, methacrylic acid ester-N-vinylpyrrolidone, fatty acid-methacrylate ester, styrene-allyl alcohol and alkylacrylate-styrene-butadiene. Other synthetic surfactants include: polyesters of carboxylic acids (e.g. polydecamethylene sebacate, alkyd resins); epoxy resins and phenolic resins (e.g. Novolacs TM); functionally terminated homopolymers such as epoxide or amine-terminated polyolefins; ionic surfactants such as copper oleate, Aerosol TM TO (sodium dioctylsulfosuccinate), triisoamylammonium picrate and aluminum octaoate and mixtures or combinations thereof. Other commercially available charge control agents useful in the art are given in R. M. Shaffert, "Electrophotography" pp. 71, 72, The Focal Press, New York (1975).

Surfactant concentration in a colloidal metal dispersion has a dramatic influence on toner fluid performance. Surfactant concentration levels that are too low result in inadequate stability of the toner fluid to flocculation; whereas high surfactant concentrations can produce high ion concentrations in the toner medium, which reduce the speed and efficiency of the development process. More preferred surfactant concentrations are at from 0.01 to 1.0 g/100 mL (.01 to 1.0 wt. %). Using OLOA TM 1200 as a surfactant, concentrations at from 0.01 to 0.12 g/100 mL in Isopar TM M or G produced toner fluids that were effective developers; however, optimum developing speed and efficiency was attained at a level of about 0.04 g/100 mL.

C. Organosol Particles and/or Soluble Polymers

Organosol particles and/or a soluble polymer can be added to a metallic toner fluid composition to provide improved properties for metallic coatings and metal platings derived from the toner fluid compositions. Organosol particles and soluble polymer additives promote adhesion of the metallic particles to a receptor during transfer of a metallic coating. The organosol particles and soluble polymer additives also reduce cohesion within a metal plating to allow an easy separation of a transferred image from a non-transferred area of a metal plating. The easy separation means that less energy is needed to perform the image transfer and that the transferred image cleanly breaks free from the non-transferred region. In addition, a much higher image resolution can be achieved during the transfer of the electrolessly plated metal. It is believed that the organosol particles and/or soluble polymer are adsorbed onto the surface of the metal particles and in this way provide the noted improved adhesion, cohesion, and resolution characteristics.

Relatively small amounts of organosol particles and/or a soluble polymer are needed in a metallic toner fluid composition to provide the above-noted improved properties. Generally, the organosol particles and/or soluble polymer are employed in the toner fluid at from about 0.005 to 5.0 weight-percent based on the weight of the toner fluid. Preferred weight-percentages range from 0.01 to 2.0, more preferably 0.05 to 1.5 weight-percent. The organosol particles and/or soluble polymer should not be added to the toner fluid to a deleterious extent. For example, relatively large amounts of organosol particles and/or a soluble polymer in a toner fluid can reduce the effective surface area of deposited metal particles so as to diminish the metal particles' catalytic activity for a subsequent electroless plating operation.

1. Organosol Particles

Organosol particles are in the colloidal size range (generally about 10 to 1,000 nm, and preferably 50 to 300 nm) and have (a) a core, and (b) a stabilizer, which are each described below in detail.

(a) The Core

The core is comprised of a polymer that is insoluble or substantially insoluble in the carrier liquid. Preferably, the core is comprised of a thermoplastic polymer having a glass transition temperature ($T_g$) greater than 25 ° C. The core polymer may be made in situ by copolymerizing core monomers with the stabilizer. The core may be made from monomers that form an insoluble polymer. Examples of monomers suitable for forming the core include ethylenically unsaturated monomers such as methylmethacrylate (MMA), ethylacrylate, vinylacetate (VAc), styrene, styrene derivatives, and mixtures thereof.

(b) The Stabilizer

The stabilizer preferably is a graft copolymer that is prepared by polymerizing at least two comonomers. The polymerizable comonomers may be monomers containing solubilizing groups and functional groups that can be converted into anchoring groups. The stabilizer typically has two polymeric components: a soluble component and an anchoring component. The soluble component constitutes a major weight proportion (usually greater than 90%) of the stabilizer, and its function is to provide a lyophilic layer covering the surface of the organosol particles. The lyophilic layer stabilizes the organosol particles so that flocculation does not occur. The anchoring group constitutes a minor (for example, less than 10 wt. %) of the stabilizer. The anchoring group provides a covalent-link between the insoluble core of the organosol particle and the soluble component of the steric stabilizer.

2. Preparing an Organosol

Organosols and their preparation have been described in the art. U.S. Pat. Nos. 4,925,776 and 4,665,002 are examples of documents disclosing organosols and their preparation. The disclosures of these patents are incorporated here by reference.

An organosol may be formed by (a) preparing a stabilizer precursor, (b) converting the stabilizer precursor into a stabilizer having an anchoring group, and (c) anchoring the stabilizer to a core polymer.

(a) Preparing a Stabilizer Precursor

A stabilizer precursor may be formed by preparing a polymer having a functional group that later (in step (b) below) can be converted into an anchoring group. Typically, a stabilizer precursor is prepared by solution polymerization, where monomers and initiators are dissolved in a suitable solvent, and the monomers are polymerized. Polymerization may be accomplished thermally or photochemically. Useful monomers are those that generate a polymer which is soluble in the solvent and which possesses a functional group that can be converted into an anchoring group. Preferably, a monomer having solubilizing groups is polymerized with a monomer having a functional group that can be converted into an anchoring group.

Examples of monomers that contain solubilizing groups include laurylmethacrylate (LMA), isooctylacrylate, octadecylmethacrylate, 2-ethylhexylacrylate, and poly(12-hydroxystearic acid), PS TM 429 (a polydimethylsiloxane with 0.5–0.6 mole % methacryloxypropylmethyl groups, and being trimethylsiloxy terminated (available from Petrarch Systems, Inc.)). Preferred monomers are LMA and isooctylacrylate.

Examples of monomers containing functional groups that can be converted into anchoring groups include azlactones such as 2-alkenyl-4,4-dialkylazlactone of the structure:

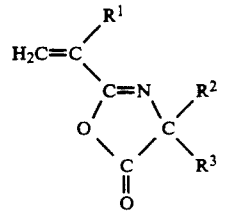

where $R^1$ is H, or an alkyl group having 1 to 5 carbon atoms inclusive, preferably 1 carbon, and $R^2$ and $R^3$ are independently a lower alkyl group of 1 to 8 carbon atoms inclusive, preferably less than 5.

Solvents suitable for use in preparing the stabilizer precursor can be those described above (I(A)(2)) for the carrier liquid.

Examples of useful initiators include known initiators, for example: 2,2-azobis(isobutyronitrile) (Vazo TM -64), 1,1'-azobis(cyanocyclohexane) (Vazo TM -88), and 2,2'-azobis(2,4-dimethylvaleronitrile) (Vazo TM -52), (all available from E.I. duPont de Nemours & Co. Inc., Wilmington, Del.); peroxide initiators, such as cumene hydroperoxide, t-butylhydroperoxide, benzoylperoxide, and dicumyl peroxide, (all available from Pennwalt Corp.); and photoinitiators such as 2,2-dimethoxy-2-phenylacetophenone (Irgacure TM 651 available from Ciba-Geigy), 2-hydroxy-2-methyl-1-phenylpropane-1-one (Darocure TM 1173 available from E. Merck) and benzoin derivatives.

(b) Converting a Stabilizer Precursor into a Stabilizer Having a Grafting Site or Anchoring Group The functional group of the stabilizer precursor is converted into a grafting site or anchoring group by reacting it with a compound containing an unsaturated group. Compounds containing unsaturated groups may possess a functional group that reacts with the stabilizer precursor. Examples of such compounds are 2-hydroxyethylacrylate, pentaerythritol triacrylate, 4-hydroxybutylvinylether, 9-octadecen-1-ol, cinnamyl alcohol, allyl mercaptan, and methallylamine. The conversion of the stabilizer precursor may occur at room or elevated temperatures depending on the reactants. The compound reacted with the stabilizer precursor may be added to the solution from step (a). A catalyst may be employed to form the stabilizer. For instance, when a stabilizer precursor derived from vinylazlactone is reacted with an unsaturated nucleophile such as 2-hydroxyethylmethacrylate (HEMA), p-dodecylbenzenesulfonic acid may be employed as a catalyst. Examples of other catalysts useful for converting a stabilizer precursor derived from vinylazlactone include: stearyl acid phosphate; methane sulfonic acid; benzene sulfonic acid derivatives; and dibutyl tin oxide. The stabilizer may also be an adduct of glycidylmethacrylate with acrylic or methacrylic acid. When the stabilizer is derived from glycidylmethacrylate and acrylic or methacrylic acid, suitable catalysts may include: dibutyl tin oxide; stearyl acid phosphate; and a calcium soap such as naphthenate or 2-ethylhexanoate; a chromium soap such as naphthenate or octanoate, Cordova Amc-2 TM triphenylphosphine; triphenylantimony; and dodecylbenzene sulfonic acid (DBSA).

Adduct Reactions

Examples of reactions for forming a stabilizer are as follows:

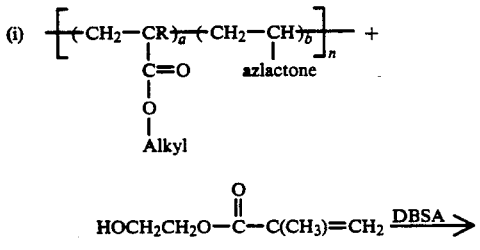

-continued

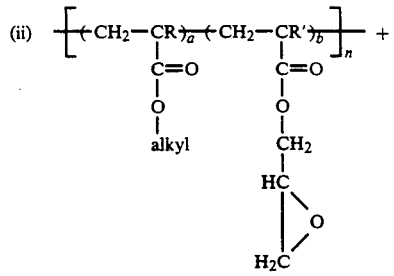

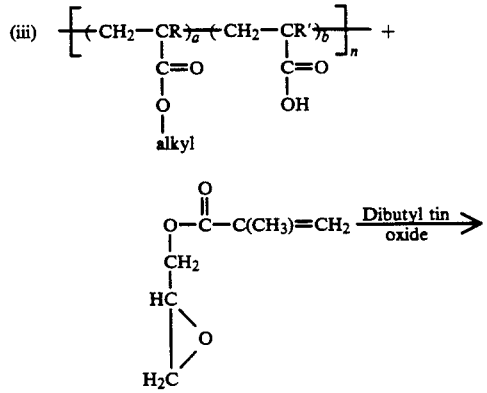

where a is about 8–10, b is less than 2, n is about 2–100, R and R' may independently represent hydrogen or methyl.

An adduct reaction with azlactone may be illustrated as follows:

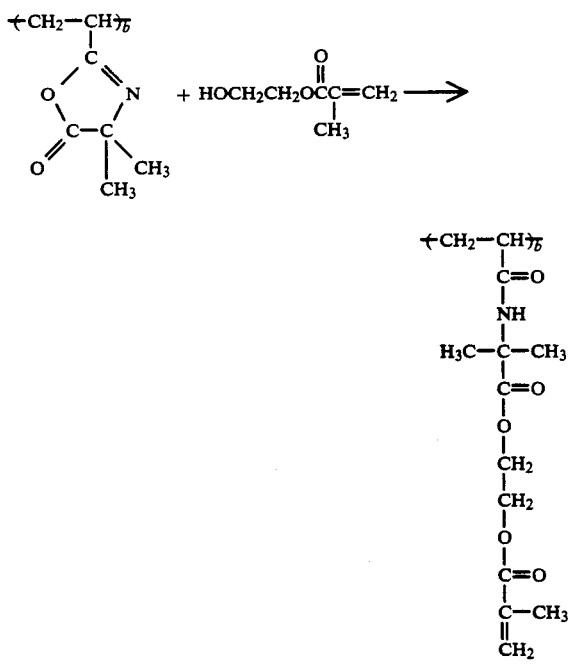

where b is as given above.

(c) Anchoring the Stabilizer to a Core Polymer

A stabilizer may be anchored to a core polymer by dispersion polymerization of a monomer(s) in the presence of a stabilizer having an anchoring group. Suitable monomer(s) may be added to the solution containing the stabilizer having the anchoring group. The monomers may be polymerized using a thermal or photochemical initiator. Useful monomers are those that can be converted into polymers which are insoluble in the solvent. Preferred monomers are those that form a polymer having a $T_g$ greater than about 25° C. Examples of such monomers are given above in the discussion of the core (I(C)(1)(b)). Examples of useful initiators are provided above in the discussion regarding preparing a stabilizer precursor(I(C)(2)(a)).

B. Polymer

A polymer may be added to the metallic toner in conjunction with the organosol or in lieu thereof. The polymer may be added to the metallic toner fluid, for example, in the form of a solution or by itself.

Useful polymers include those (other than surfactant polymers) that are compatible with the carrier liquid of the toner fluid composition. A polymer is compatible if it is at least substantially soluble in the solvent of the carrier liquid. The polymer should be soluble enough to remain in the carrier liquid; that is, it should not precipitate from the carrier liquid. The polymer may possess insoluble components, but, generally, only as a minor component. The insoluble components may not make the polymer as a whole insoluble in the carrier liquid. The polymer is not a significant contributor of electrostatic charge to the metal particles of the toner fluid, and, in this regard, the soluble polymer used does not function as a surfactant.

The polymer selected will depend on the properties of the carrier liquid. When using a non-polar carrier liquid, typical polymers may include amorphous polymers having molecular weights of less than 500,000, preferably less than 100,000. Preferred amorphous polymers have molecular weights of at least 10,000, preferably at least 20,000. Preferred amorphous polymers include acrylics and silicone polymers. Preferred acrylic polymers are those having a long side chain, preferably at from eight (8) to sixteen (16) carbon atoms in the side chain. Examples of preferred polymers and copolymers include laurylacrylate, LMA, isobornylacrylate, octadecylmethacrylate, 2-ethylhexylacrylate, t-octylacrylamide, PS $_{TM}$ 429, and mixtures thereof.

Although amorphous acrylic and silicone polymers are preferred, it is within the scope of this invention to select other soluble, non-surfactant polymers such as polyolefins, polystyrenes, and hydrocarbon resins. It is also within the scope of this invention to use mixtures of soluble non-surfactant polymers. And it is to be understood that the definition of a soluble, nonsurfactant, polymer includes (but is not limited to) copolymers, block copolymers, graft copolymers, homopolymers, etc.

The polymer may be added to the toner fluid in the form of a solution. The solvent selected for the polymer solution preferably is compatible with the polymer and the toner fluid. Compatible solvents are capable of substantially dissolving the polymer and not destabilizing the toner fluid. Examples of suitable solvents are described above in the discussion of the carrier liquid (I(A)(2)).

If the polymer is used in the composition without an organosol, the polymer would generally be employed at from 0.005 to 5.0 weight-percent based on the weight of the toner fluid composition. Preferably, the polymer is employed in the range of 0.1 to 2.0 weight-percent. More preferably, the polymer would be used at from 0.5 to 1.5 weight percent.

II. ELECTROPHORETIC DEPOSIT OF METALLIC PARTICLES

In a method of this invention, colloidal metal particles of a toner fluid are electrophoretically deposited on a substrate to produce a uniform, nonconductive, metallic coating on the substrate surface. When the colloidal metal particles are electrophoretically deposited on the substrate, the organosol particles and/or the soluble polymer(s) are transferred to the substrate with the metal particles. The organosol particles and/or soluble polymer(s) "coat" the metal particles so as to become "interspersed" between them.

The substrate employed may be conductive, photoconductive, or dielectric. Substrates may be in the form of thin, 2-dimensional, planar sheet constructions; although alternative substrate constructions are possible. Suitable conductive substrates include dielectric substrates having indium tin oxide, tin oxide, or cupric iodide coated thereon. Theoretically, the conductive substrate may be any thin metal sheet or metal coated substrate. Suitable dielectric substrates include virtually any nonconductive organic or inorganic solid, particularly polymeric and ceramic materials readily fabricated into thin films or other appropriate constructions. Suitable photoconductive substrates may be of the organic or inorganic type, such as those described in R.M. Schaffert, *Electrophotography*, pp. 60–69, 260–396, New York (1975). Examples of useful substrate compositions include dielectric polymers such as: Kapton TM polyimide (duPont de Nemours & Co. Inc., Wilmington, Del.), polypropylene and polyethylene terephthalate (PET); inorganic dielectric materials such as aluminum oxide and silica-based glasses; and photoconductive film constructions such as: Kodak Ektavolt TM Recording Film SO-102 (Eastman Kodak Co., Rochester, N.Y.); and bis-5,5'-(N-ethylbenzo[a]carbazolyl)-phenyl methane (BBCPM) based photoconductive films described in U.S. Pat. Nos. 4,337,305 and 4,356,244.

Electrophoretic deposition may be achieved using known electrographic coating and imaging techniques. These techniques generally involve sensitizing or charging the substrate surface by, for example, depositing positive or negative ions generated in a corona discharge, followed by developing charged areas of the substrate by electrostatically attracting oppositely-charged toner-fluid particles. Alternatively, an external electric field may be applied to drive charged toner-fluid particles to the substrate surface. A number of variations on these basic processes are known in the art, but all basically rely on mobility of electrostatically charged toner particles in an electric field to achieve a controlled deposit of particles on the substrate surface.

Coatings produced by the above-noted methods may be in the form of, for example, continuous films covering the entire substrate surface or patterned images. Patterned images are produced by selectively charging or discharging the substrate surface to form a latent electrostatic image, which is subsequently developed by an electrophoretic means. Alternatively, a patterned image may also be formed using an electrophoretic stylus.

Standard electrophotographic equipment can be used for producing colloidal metal coatings and patterned images on a variety of substrates. A particularly useful electrophotographic set-up may consist of the following components: 1) a corona-discharge unit for depositing a charge on a substrate surface; 2) a projection exposure unit for generating a latent electrostatic image on a photoconductive substrate; and 3) an extrusion-type developing station for contacting the charged substrate with toner fluid of the invention and providing controlled colloidal metal deposition on the substrate surface through application of a potential bias. Representative methods of producing colloidal metal coatings or patterned images using this equipment are included in the examples provided below.

The colloidal metal particles may be electrophoretically deposited on a substrate at various densities. The density of the particles depends on a number of parameters, including substrate film thickness, corona-charging potential, bias voltage applied to the developing station, and development time. With transparent substrates, relative metal loadings in the coated areas can be estimated from measured optical densities of the coated film. For fixed surface potential, metal loadings decrease with increasing substrate film thickness.

When using dielectric or photoconductive substrates, it is preferred that the substrate have a thickness of less than approximately 1270 micrometers (50 mil), and more preferably less than 255 micrometers (10 mil). At the highest metal loadings generated on ultrathin (6 micrometer) polyester film, colloidal metal coatings are still nonconductive (according to two probe resistance measurements which indicated an absence of extended contacts between metallic particles).

In a preferred embodiment of this invention, colloidal metal particles and organosol particles and/or a soluble polymer(s) can be deposited on a BBCPM based photoconductive film construction as described in example 26 of U.S. Pat. No. 4,337,305. The particles may be deposited in the form of high resolution, nonconductive, metallic images. High resolution imaging can be achieved by first charging the entire surface of the photoconductor in a corona discharge. A patterned image may then be obtained by selectively discharging the surface of the photoconductor. This can be accomplished by exposing the surface to an image projected through a high resolution target. After exposure, a latent electrostatic image is formed, which may be developed under a controlled bias potential using a metallic toner fluid dispersion of the invention. The development produces a corresponding colloidal metal image. Nonconductive metallic images have been obtained which have a resolution of up to 240 line-pairs/mm or individual line widths of equal to or greater than 2.0 micrometers. Based on the average size of the colloidal metal particles, resolution in the submicrometer range is expected to be feasible with more sophisticated electrophotographic equipment.

III. METHOD OF METAL PLATING

Metal plating may be achieved by an electroless means using an electrophetically-deposited-metallic-coating on a substrate. Electrophoretically-deposited-metal-particles of a metallic coating function as catalysts that promote electroless metal plating. The electrophoretically-deposited-metal-particles are contacted with an electroless metal plating solution for a time sufficient to induce metal plating, typically 0.5 to 30 minutes. Electroless metal plating occurs selectively in areas on the substrate surface where the metal particles have been deposited. The deposited particles become metallized in the electroless plating process and exhibit excellent electrical conductivity. The electroless platings can have a total thickness of up to about 30 micrometers, preferably (for printed circuit applications) in the range of 1.0 to 20 micrometers. At resolutions of up to 150 line-pairs/mm, image enhancement and electrical conductivity may be achieved with negligible resolution loss.

Metals known to be useful as catalysts for electroless plating include metals from Periodic Table Groups 8-11 (CAS notation). Particularly useful catalysts include late transition metals such as Cu, Ni, Ag, Au, Pt, Pd, and combinations thereof. In this invention, deposited Pd particles are preferred for use in electroless metal plating.

Electroless plating solutions have been described in the art. These solutions minimally contain a metal salt and a reducing agent in an aqueous or organic medium. In an electroless plating process, the metal in the metal salt is catalytically reduced to its elemental form and is deposited as such. Salts of a variety of metals have been shown to be effective for this purpose. Additionally, combinations of metals can also be electroless plated. Particularly useful electroless plating solutions are aqueous solutions of copper, nickel, or cobalt which are readily prepared or are available from a variety of commercial sources and are described in J. McDermott, *Plating of Plastics with Metals*, pp. 62 and 177, Noyes Data Corporation, Park Ridge, N.J., (1974).

IV. METHOD OF TRANSFERRING DEPOSITED TONER FLUID PARTICLES AND METAL PLATINGS

Metallic coatings may be transferred from a primary receiving substrate to a secondary receiving substrate. The transfer may be accomplished using thermal mass transfer printing techniques. Metallic coatings may be transferred in an imagewise fashion from a primary receiving substrate to a secondary receiving substrate by selectively applying heat and pressure. Metallic coatings to be transferred may include electrophoretically-deposited-metal-particles by themselves and deposited metal particles that have been electrolessly plated with metal. The organosol particles and/or soluble polymer are believed to be in contact with the deposited metal particles and become transferred therewith. When a metal coating of electrophoretically-deposited-metal-particles is employed, the transferred metal is nonconductive, but can be made conductive by subsequently exposing the coated secondary receiving substrate to an electroless plating solution. The thermal mass transfer and electroless plating steps therefore may be performed in either order.

A number of available thermal printing techniques may be used in a mass transfer metallic imaging process. In a preferred embodiment of this invention, thermal mass transfer metallic imaging is achieved using a digital printer equipped with a thermal-mass-transfer-type-print-head. The benefits of these printers in thermal mass transfer printing applications are described in U.S. Pat. No. 4,839,224. Using such a thermal printer, metallic images are produced by first positioning a metal-coated primary receiving substrate in contact with heating elements of a thermal print-head. A secondary receiving substrate is placed in contact with the primary receiving substrate on the side of the primary receiving substrate opposite to, but essentially colinear with, the heating elements of the thermal print-head. The thermal print-head is activated to supply heat selectively to areas of the primary receiving substrate to cause adhesive bonding of metal to the secondary receiving substrate. Subsequent separation of the primary and secondary substrates results in the transferred metal adhering to the secondary receiving substrate. An optional final radiation or thermal fusion step may be used to further promote adhesion of the metallic images to the secondary receiving substrate.

When image transfer is by use of the thermal-mass-transfer-type-print-head just described, the dimensions and physical properties of the primary receiving substrate are important to the effectiveness of the thermal mass transfer metallic imaging process and the quality of the final metallic images. Preferably, the primary receiving substrate is thin so that it may provide efficient heat transfer to the receptor. Substrate thicknesses are generally less than 15 micrometers, preferably less than 9 micrometers, and more preferably less than 6 micrometers. Furthermore, the primary receiving substrate composition preferably is non-thermoplastic at the temperatures generated by the thermal printer to prevent sticking of the thermal print-head to the primary substrate. It is preferred that $T_g$ of this substrate is generally greater than 80° C., and preferably greater than 120° C. Substrate materials that can be used for this purpose include (but are not limited to): cellophane, and high $T_g$ synthetic resin films such as polyesters, polyamides, polyethylenes, polycarbonates, polystyrenes, polyvinylacetate, polyvinylalcohol, polyethylene, and polypropylene.

In another embodiment of this invention, thermal mass transfer may be achieved by passing the primary and secondary receiving substrates through a heat/pressure roller system in an overlaying relationship. Or, in a further embodiment, the primary and secondary receiving substrates may be exposed to high intensity infrared radiation while being held in intimate contact with each other. The preferred method of thermal mass transfer can vary according to the suitability of apparatus for the particular kind of substrate that is being used and the intended use of the product derived from the process. The two embodiments noted in this paragraph are especially useful for transferring metal particles that have been deposited on the primary receiving substrate in an imagewise fashion.

The secondary receiving substrate may be chosen from a wide variety of materials and a wide variety of shapes and thicknesses. The substrate may be in the form of sheets, films, or solids. Suitable materials may include (but are not limited to) paper, glass, ceramics, metals, wood, fabrics, polymeric materials including thermoplastic, laminates of combinations of these materials, and other materials commonly used as substrates for metal images.

The secondary receiving substrate may be a thermoplastic polymer film or may be comprised of a thermoplastic polymer coating on a supporting film base. Thickness of the thermoplastic coating should be greater than 1 micrometer and preferably greater than 5 micrometers. In general, $T_g$ of the thermoplastic component should be between 0° and 220° C. and preferably between 20° and 150° C. Thermoplastic polymers that can be used in the receptor sheets of this invention include (but are not limited to) polyesters such as Vitel TM PE 200 and polyethylene terephthalate, nylons such as polyhexamethylene adipamide, polyethylenes (high and low density), polypropylenes, polyvinylchloride, polystyrenes, acrylic resins, and copolymers of the above classes such as, for example, polyethyleneacrylic acid.

When transferring metallic coatings that have not been electroless plated, the secondary receiving substrate may be non-thermoplastic. Non-thermoplastic substrates may be composed of materials that do not have adhesive properties at the transfer temperature. Examples of such substrates are given above. Preferred substrates have an indium tin oxide, tin oxide, or cupric oxide coating on a supporting surface, for example, a surface of polyethylene, polyimide, polycarbonate, or the materials provided above.

The thermal energy required to achieve thermal transfer of metallic images depends to a large extent upon the primary and secondary receiving substrates. Typically, it is desired to use a minimum print-head energy to achieve thermal mass transfer for a given donor/receptor combination because minimum print-head energy prolongs the life of the print-head and also minimizes thermal degradation of the primary substrate. Generally, the print-head is operated at an energy of 1–10 J/cm$^2$ and preferably at from 1.6 to 2.5 J/cm$^2$.

For direct transfer of conductive metal images, the thickness of the electroless plated metallic coating on the primary receiving substrate is also important: if it is too thin, the metallic coating will not exhibit good electrical conductivity, and if it is too thick, the cohesive strength of the metallic coating will inhibit thermal mass transfer. Electroless metal plated coatings having a thickness of between 0.03–0.1 micrometers, preferably between 0.05–0.08 micrometers, have been found to work well in this process of the invention.

V. ARTICLE BEARING A METALLIC COATING

An article bearing a metallic coating comprises a substrate, elemental metal particles, and organosol particles and/or a nonsurfactant polymer. The elemental metal particles and the organosol particles and/or nonsurfactant polymer are deposited on the substrate. The deposited particles may appear as a continuous metal coating, but when viewed with an electron microscope, discrete metal particles may be seen. The elemental metal particles may have sizes that may range from about 1 to 250 nm. Preferably, the elemental metal particles and the organosol particles and/or nonsurfactant polymer are in contact with each other on the substrate. The organosol particles and/or nonsurfactant polymer, preferably, do not completely cover the surfaces of the metal particles. In this way, the article can also include an electroless metal plating layer over the elemental metal particles. Not including metal of an electroless metal plating layer, elemental metal particles and organosol particles and/or nonsurfactant polymer may be employed on the substrate at a weight ratio range of from 1:100 to 100:1, more typically 1:10 to 10:1. Thickness of the deposited elemental metal particles and organosol and/or polymer on the substrate may be about 10 to 150 nm. When an electroless metal plating is placed over the deposited elemental metal particles, the thickness of the metal plating may be about 10 to 100 nm. This thickness can be increased by extending the duration of the electroless plating operation. Thicknesses of up to 30 micrometers may be achieved if the substrate is exposed to the electroless plating solution for a relatively long period of time (about sixteen hours). One to two minutes, however, is a more typical development time. Other preferred forms of the article have been discussed above.

Articles bearing nonconductive, elemental metal coatings may be used in catalysis (that is, electroless plating), and optical or magnetic recording. Electroless plated articles (in which the original elemental metal coating has been enhanced and made electrically conductive) may be used in electronics as printed circuits or microcircuits or as materials for antistatic control, and they may also be used in graphics reproduction to produce metallized graphics or in optical devices to absorb, reflect, or otherwise modulate various types of radiation.

Objects, features and advantages of this invention are further illustrated in the following examples. It should be understood, however, that the particular ingredients and amounts recited in the examples, as well as other conditions and details, are not to be construed in a manner that would unduly limit the scope of this invention.

EXAMPLE 1

Preparing an Organosol (i) Preparing a Stabilizer Precursor

A 250 ml 3-necked round bottomed (RB) flask equipped with a thermometer, a stirrer, and a reflux condenser connected to a $N_2$ source was charged with a mixture of 48.5 grams of lauryl methacrylate, 1.5 grams of 2-vinyl-4,4-dimethylazlactone, 0.5 grams of azobisisobutyronitrile (AIBN), and 109.2 grams of heptane. The mixture was purged with $N_2$ for 10 minutes at room temperature and was then heated at 70° C. for 8 hours under $N_2$. A clear polymeric solution was obtained. The experimental solids content was 31% with good conversion.

(ii) Reacting the Precursor (i) with 2-Hydroxyethylmethacrylate (HEMA)

The above polymer solution (i) was charged with a mixture of 1 gram of HEMA, 0.75 grams of 10% p-dodecylbenzenesulfonic acid in heptane, and 7.5 grams of heptane. The resulting solution was stirred at room temperature for 8 hours. The IR spectra of a dry film of the polymeric solution showed the disappearance of the azlactone carbonyl peak (5.45 micrometers), indicating that the reaction of azlactone with HEMA was complete.

(iiia) Preparing an Organosol having Particles with a Polymethylmethacrylate Core A 1 liter 3-necked RB flask equipped with a thermometer, a stirrer, and a reflux condenser connected to a $N_2$ line was charged with a mixture of 126.1 grams of the above stabilizer (ii) (35.7% solids in heptane), 105 grams of methylmethacrylate (MMA), 369 grams of heptane, and 1.05 grams of AIBN. The resulting solution was flushed with $N_2$ for 10 minutes, and was then polymerized at 70° C. for 2 hours under $N_2$. An additional 50 grams of heptane was added to lower the viscosity. Polymerization continued at 70° C. overnight. The resulting organosol was very stable, and the conversion was good.

(iiib) Preparing Organosol Particles having a Polyvinylacetate Core

An alternative organosol was prepared as follows: a 250 ml 3-necked RB flask equipped with a thermometer, mechanical stirrer, and a reflux condenser connected to a $N_2$ line was charged with a mixture of 44.7 grams of the above stabilizer (ii) (31% solids in heptane), 31.5 grams of vinylacetate, 0.47 grams of AIBN and 74.8 grams of heptane. The resulting solution was flushed with $N_2$ and polymerized at 70° C. for 7 hours. The resulting polymer dispersion is very stable with 29.8% solids.

EXAMPLES 2–11

All organic carrier liquids used in the following Examples had volume resistivities greater than $10^{11}$ ohm-cm, and dielectric constants less than 3.5.

EXAMPLE 2

This example describes a typical procedure for preparing a colloidal metal dispersion in a nonconductive organic liquid medium of low dielectric constant which contains a dissolved surfactant. The dispersion was prepared using a Gas Evaporation Reactor (GER) to evaporate metal particles and transfer them to a liquid medium. In a GER equipped with a direct drive mechanical vacuum pump, palladium metal was evaporated from a resistively heated, alumina coated, tungsten crucible into a stream of argon gas with a flow rate adjusted such that the internal reactor pressure was maintained at approximately 10 Torr. As the palladium vapor was carried away from the crucible in the gas stream, metal clustering occurred. The stream of palladium particles was bubbled through a solution containing 0.04 wt. % OLOA TM 1200 surfactant in Isopar TM G at 0° C. Palladium particles captured by the solution formed a dark transparent dispersion containing 0.02 wt. % palladium. The colloidal dispersion appeared to be indefinitely stable under ambient conditions with no noticeable settling or flocculation over a period of months. Analysis of the dispersion by photon correlation spectroscopy revealed a mean number average palladium particle size of 23.7 nm with a standard deviation of 9.6 nm. Electrophoresis measurements indicated that the suspended palladium particles were negatively charged.

EXAMPLES 3 AND 4

The compositions of Examples 3 and 4 use the toner of Example 2, but also contain small amounts of organosol. The metal particles of the toner fluid (containing an organosol) are electrophoretically deposited (Example 3) on a polyethylene terephthalate (PET) substrate followed by electroless plating of copper (Example 4) onto a surface of a substrate containing the colloidal toner.

EXAMPLE 3 (ELECTROPHORETIC DEPOSIT)

The toner of Example 2 was modified by mixing the colloidal Pd dispersion with 0.1 wt. % of MMA/LMA (70/30 wt. %) core/shell organosol of example 1, part iiia. Electrophoretic reverse depositing techniques were used to coat a thin layer of the Pd/organosol particles onto a 6 micrometer thick substrate of PET (E.I. du-Pont de Nemours & Co., Inc., Wilmington, Del.). The PET substrate was adhered to a grounded aluminum plate by applying a thin layer of ethanol at the PET-aluminum interface. The entire assembly was passed through an extrusion type developing station commonly used in liquid toner development. With the PET substrate in contact with the meniscus of the colloidal Pd/organosol dispersion, a 200 volt negative bias voltage was applied to the developing station such that the negatively charged palladium particles were repelled and driven to the surface of the PET substrate. A continuous colloidal elemental metal coating was produced along the width of the developing station. The coating speed was approximately 60 cm/min. The dried Pd/organosol layer had a surface potential ranging from 40 to 100 volts with a transmission optical density of (TOD) 0.02–0.04 as measured on a MacBeth densitometer.

EXAMPLE 4 (CU PLATING)

The coated substrate of Example 3 was immersed in a Cuposit TM 328 electroless plating solution (Shipley Company Inc., Newton, Mass.), at room temperature for 10–15 minutes. The resulting copper coating was approximately 0.1 micrometer thick, and had a TOD of 1.30 as measured on a MacBeth densitometer. The copper coating was shiny, conductive, and flexible. Adhesion to the PET substrate was excellent.

EXAMPLE 5 (TRANSFER OF METAL COATING)

The copper coated substrate of Example 4 was used as a donor sheet for thermally transferring conductive copper images directly to a thermoplastic receptor. The thermoplastic receptor was a 100 micrometer thick PET substrate coated with a 10 micrometer thick layer of polyethylene-acrylic acid (EAA), (Dow Chemical, Midland, Mich.). Thermal transfer of the metallic images was accomplished using a digital-thermal-mass-transfer-printer equipped with an OKI 200 dots per inch (dpi) (8 dots per millimeter (dpmm)) print-head which operated at 3.0 J/cm$^2$. A mesh pattern was generated using a VAX TM computer. The pattern consisted of two groups of parallel lines which intersected at right angles. The pattern was stored in a mass memory device to control the thermal printer. The donor sheet was positioned in the printer between the thermal print-head and the thermoplastic receptor sheet, and was in contact with the thermal print-head. The thermal print-head was activated to supply heat selectively to areas of the donor/receptor sheets causing localized softening of, and transfer of the copper film to, the thermoplastic receptor in the predefined image configuration. Operation of the OKI print head in the manner described allowed clean transfer of the electrically conductive images to the receptor with a resolution of 200 dpi (8 dpmm).

EXAMPLE 6 (ELECTROPHORETIC DEPOSIT)

The method of Example 3 was repeated using 1 wt.% of a VAc/LMA, (70/30 wt. %) core/shell organosol of example 1 (part iiib) in place of the 0.1 wt. % of MMA/LMA, (70/30 wt. %) core/shell organosol. A continuous colloidal elemental metal coating was produced on a PET substrate along the width of the developing station. The coating speed was approximately 60 cm/min. The dried Pd/organosol layer had a surface potential ranging from 40 to 100 volts and a TOD of 0.02–0.04 as measured on a MacBeth densitometer. The substrate coated with the Pd/organosol layer was then baked at 80° C. for three minutes to remove any solvent.

EXAMPLE 7 (IMAGE TRANSFER AND METAL PLATING)

The coated substrate of Example 6 was used as a donor sheet for the thermal transfer of the Pd/organosol toner layer onto a non-thermoplastic indium tin oxide (ITO) coated receptor in an imagewise manner. The thermal transfer of the metallic images was accomplished using a digital thermal mass transfer printer equipped with an OKI 200 dpi (8 dpmm) print-head, which operated at 3.0 J/cm$^2$.

A pattern of continuous parallel lines of varying line width was generated along the length of the receptor using a VAX TM computer. The pattern was stored in a mass memory device to control the thermal printer. The donor sheet was positioned in the printer between the thermal print-head and the ITO coated receptor. The donor sheet was in contact with the conductive side of the ITO coated receptor. The thermal print-head was activated to supply heat selectively to areas of the donor/receptor sheets causing localized transfer of the Pd/organosol layer to the ITO coated receptor in a predefined image configuration. There was a clean transfer of the image to the ITO receptor. A resolution of 200 dpi (8 dpmm) was obtained (limited by the resolution of the printer).

The ITO receptor was then immersed in a Cuposit TM 328 electroless plating solution (Shipley Company Inc., Newton, Mass.) at room temperature for 10 minutes. All of the transferred images were converted to shiny copper images. The TOD was measured to be approximately 0.8. The thickness of the metallic images was estimated to be approximately 0.1 micrometers. An ohm meter was used to check the conductivity of the Cu images and the conductive continuity between the Cu image and the ITO. No detectable resistance was found. The contact resistivity was estimated to be approximately 10–100 TM ohm-cm.

EXAMPLE 8 (IMAGE TRANSFER)

The coated substrate of Example 6 was used as a donor sheet for the imagewise thermal transfer of the Pd/organosol toner onto a 100 micrometer thick PET receptor. This receptor substrate has non-adhesive properties at the transfer temperature. The thermal transfer was accomplished using the techniques and parameters described in Example 7. The PET receptor substrate containing the Pd/organosol toner image was then immersed in a Cuposit TM 328 electroless plating solution (Shipley Company Inc., Newton, Mass.), at room temperature for 10 minutes. All the toner images were converted to shiny copper images. The TOD was measured to be approximately 0.8. The thickness of the metallic images was estimated to be approximately 0.1 micrometers.

EXAMPLE 9 (PREPARING A TONER CONTAINING A SOLUBLE POLYMER AND ELECTROPHORETICALLY DEPOSITING THE TONER PARTICLES)

The toner of Example 2 was modified by mixing the colloidal Pd dispersion with a polymer solution. The polymer of the solution was added to the toner at 1.0 wt. % based on the weight of the toner fluid composition. The polymer solution contained 30 wt. % MMA/LMA copolymer (30/70 wt. %) in toluene. An electrophoretic reverse deposit technique was used to coat a thin layer of Pd on a 6 micrometer PET substrate. The reverse bias voltage for the deposit was approximately 200 volts, and the coating speed was about 60 cm/min. The dried Pd layer had a surface potential of about 40–100 volts and a TOD of 0.02–0.04.

EXAMPLE 10 (METAL PLATING)

The coated substrate of Example 9 was immersed in a Cuposit TM 328 electroless plating solution at room temperature for about ten to fifteen minutes. Cu plating occurred. From the TOD, the resulting Cu plating was estimated to be about 0.1 micrometers thick. The metal plating was shiny, conductive, and flexible. Adhesion to the PET substrate was excellent.

EXAMPLE 11

The procedures of Examples 9 and 10 were followed, except that (1) a polymer in solution was added to the toner fluid composition at 0.5 wt. % based on the weight of the toner fluid composition; and (2) the polymer solution contained 30 wt. % of an isooctylacrylate/t-octylacryamide copolymer (30/70 wt. %) in toluene. Similar results were obtained.

Various modifications and alterations of this invention will become apparent to those skilled in the art without departing from the scope and spirit of this invention. It therefore should be understood that this invention is not to be unduly limited to the illustrative embodiments set forth above.

What is claimed is:

1. A metallic toner fluid composition, which comprises:

(A) electrostatically charged, colloidal, elemental metal particles dispersed in an organic carrier liquid having a dielectric constant of less than about 3.5 and a volume resistivity greater than about $10^{12}$ ohm-cm;

(B) a soluble surfactant in an amount sufficient to charge and stabilize the colloidal metal dispersion; and (C) an effective amount of organosol particles, at least one soluble polymer other than a soluble surfactant (B), or a mixture thereof.

2. The toner fluid composition of claim 1, wherein component (C) is present in the toner fluid composition at from about 0.005 to 5.0 weight-percent based on the weight of the toner fluid composition.

3. The toner fluid composition of claim 2, wherein component (C) is present in the toner fluid composition at from 0.01 to 2.0 weight-percent.

4. The toner fluid composition of claim 3, wherein the component (C) is present in the toner fluid composition at from 0.05 to 1.5 weight-percent.

5. The toner fluid composition of claim 1, wherein component (C) comprises an effective amount of organosol particles.

6. The toner fluid composition of claim 5, wherein the organosol particles are present at from 0.005 to 5.0 wt. percent based on the weight of the toner fluid composition.

7. The toner fluid composition of claim 1, wherein the component (C) comprises an effective amount of a soluble polymer.

8. The toner fluid composition of claim 7, wherein the soluble polymer is present at from about 0.005 to 5.0 weight-percent based on the weight of the toner fluid composition.

9. The toner fluid composition of claim 1, wherein the organosol particles each have (a) a core that is insoluble in the carrier liquid and (b) a stabilizer which contains solubilizing components, wherein the core (a) comprises a thermoplastic polymer having a glass transition temperature greater than 25° C. and the stabilizer (b) is a copolymer.

10. The toner fluid composition of claim 9, wherein the stabilizer is the reaction product of two monomers, a first monomer containing a functional group that can be converted into an anchoring group and a second monomer containing a solubilizing group.

11. The toner fluid composition of claim 9, wherein the stabilizer consists essentially of a polymer containing two components, a first component being soluble in the carrier liquid, and a second component being insoluble in the carrier liquid, the soluble component constituting a larger portion of the stabilizer and providing a lyophilic layer over the surface of the organosol particle.

12. The toner fluid composition of claim 10, wherein the anchoring group is an insoluble component of the stabilizer and comprises less than 10 weight percent of the stabilizer.

13. The toner fluid composition of claim 12, wherein the anchoring group provides a covalent bond between the stabilizer's soluble component and the core of the organosol particle.

14. The toner fluid composition of claim 8, wherein the soluble polymer is an amorphous polymer having a molecular weight at from 10,000 to 500,000.

15. The toner fluid composition of claim 14, wherein the amorphous polymer has a molecular weight at from 20,000 to less than 100,000.

16. The toner fluid composition of claim 15, wherein the soluble polymer is an acrylic polymer having from 8–16 carbons in a side chain.

17. The toner fluid composition of claim 1, wherein the electrostatically charged, colloidal, elemental metal particles are nonferromagnetic.

* * * * *

UNITED STATES PATENT AND TRADEMARK OFFICE

CERTIFICATE OF CORRECTION

PATENT NO. : 5,089,362

DATED : February 18, 1992

INVENTOR(S) : Chou et al.

It is certified that error appears in the above-identified patent and that said Letters Patent is hereby corrected as shown below:

Col. 5, line 54, "10-ohm-cm" should be --$10^{14}$ ohm-cm.--.

Col. 6, Line 58, "TO" should be --OT--.

Signed and Sealed this

Twenty-eighth Day of September, 1993

Bruce Lehman

*Attest:*

BRUCE LEHMAN

*Attesting Officer*

*Commissioner of Patents and Trademarks*